United States Patent [19]

Powell et al.

[11] 4,128,401

[45] Dec. 5, 1978

[54] CELLULAR SOLVENT REFINED COAL AND METHODS FOR MAKING SAME

[75] Inventors: Justin C. Powell; Matthew A. McMahon, both of Wappingers Falls, N.Y.

[73] Assignee: Texaco Inc., New York, N.Y.

[21] Appl. No.: 793,703

[22] Filed: May 4, 1977

[51] Int. Cl.[2] ..... C10L 9/08

[52] U.S. Cl. ..... 44/1 R; 44/1 B

[58] Field of Search ..... 44/1 R, 1 B; 208/8; 423/445, 449

[56] References Cited

U.S. PATENT DOCUMENTS

| | | | |
|---|---|---|---|
| 3,666,526 | 5/1972 | Ettinger et al. | 423/445 X |
| 3,775,344 | 11/1973 | Amagi et al. | 423/445 X |
| 3,786,134 | 1/1974 | Amagi et al. | 423/449 |
| 3,830,740 | 8/1974 | Amagi et al. | 423/445 X |

*Primary Examiner*—Carl Dees

*Attorney, Agent, or Firm*—Thomas H. Whaley; Carl G. Ries; Henry W. Archer

[57] ABSTRACT

Described is a cellular form of solvent refined coal characterized by a decreased density enabling it to float on water. Various methods are presented for introducing cells throughout the coal including the use of cell-forming agents; sintering; particle or gas dispersion; and leaching salts incorporated in the coal.

10 Claims, No Drawings

CELLULAR SOLVENT REFINED COAL AND METHODS FOR MAKING SAME

BACKGROUND OF THE INVENTION

1. Field of the Invention

The present invention is concerned with a cellular form of solvent refined coal, hereinafter denominated "SRC", and to methods for making such coal.

The invention is based on the unobvious and unpredictable discovery that numerous interconnecting or closed cells can be introduced throughout a mass of solvent refined coal so as to transform it into a two-phase, gas-solid composition of matter in which the solid is a continuous phase.

2. State of the Art

Many natural materials are porous, such as certain gem stones and minerals, but appear to be continous solids because their pores are minute and widely spaced and therefore constitute a very small fraction of the volume of the material. These materials are not generally considered to be cellular in nature. Some natural materials which are cellular in nature include sponges and wood.

Synthetic cellular solid materials are also known. Rubber, plastic, glass, sulfur, metal, and vitreous carbon are examples of materials which have been produced in cellular form. These reticulated gas-solid system are often called foams because they are generated by introducing a gas in the material to be foamed while it is a plastic mass. Agents added to produce a gas are known in the art as blowing agents. However, foams or cellular forms of materials can be obtained by various other methods such as sintering particles together; leaching out solid materials, such as salts, from insoluble continuous phases; mechanically dispersing a quantity of gas into a fluid plastic phase; and dispersing small cellular particles or microballons. All these methods are applicable to SRC and various techniques such as introducing activators, surfactants, and nucleating agents, lowering external pressure, and closely controlling temperature are suitable.

The conditions and methods used to produce cellular SRC depend on economics, environmental considerations, the use of the product, and the properties of the SRC. The method, agents added, temperature, time, pressure, concentrations of additives, etc. to produce cellular SRC give different degrees of density reduction, determine whether the cells are open (interconnecting) or closed, and affect the size, shape, and distribution of cells.

Most of the technology for producing synthetic cellular materials has been in the area of using blowing agents added to materials which are fluid plastic masses at temperatures well below the temperatures where at least some solvent refined coals are fluid. Thus many blowing agents are not suitable for raw solvent refined coal because their gas generation is usually too rapid at temperatures where SRC can be foamed.

SUMMARY OF THE INVENTION

Viewed in its product aspect, the present invention comprises a composition of matter consisting of solvent refined coal characterized by having a plurality of interconnecting or closed cells, an apparent density less than 1 g/cc and a void volume of 5 to 99%.

Viewed in its method aspect, the present invention resides in steps subsequent to solvent refining of coal for incorporating a plurality of cells therein.

The modifications of the method can be outlined as follows:

I. A. The state of the coal may be (a) raw SRC or (b) "solvent" modified SRC (which has a lower melting point range). All methods can use either state depending on the melting range required by the method. Some methods could benefit from a lower melting range (e.g. use of blowing agents with low decomposition temperature ranges).

B. The form of the SRC of method I.A. may be (a) a liquid or a melt or (b) a solid or a powder.

II. Limited methods

A. Frothing can only be done from IB(a)

B. Sintering can only be done from IB(b).

III. Single step methods (from any form headed I)

A. Heating which alone produces a fluid plastic mass which is expanded by in situ generated gases (no gas generating additives except in the case of method IA(b) where "solvent" vapors may be primarily responsible for the generated gas).

B. Addition of blowing agents as set forth in Examples IV, XI, XIV, below.

Various heating times: 1 sec to 20 minutes or more at various pressures: superatmospheric, atmospheric, subatmospheric.

IV. Incorporation of immiscible bodies which give rise to regions of low density. This method can be carried out by starting with methods IA(a) or (b) and in form IB (a) by methods IIA or any III, or it can be accomplished by starting with IA(a) or (b) and in form IB(b) by methods IIB or any of the methods headed III.

A. Incorporation of immiscible low density masses to give a synthetic cellular SRC.

B. Incorporation of immiscible, leachable masses which are subsequently leached to leave a void (interconnecting only).

V. The following combinations of methods also are suitable.

A. IIA plus III (any method therein).

B. IIA plus IV in a molten or liquid form.

C. IIB plus IV in a powdered form.

D. IIIA plus IIIB.

E. IIIA plus IV.

F. IIIB plus IV.

G. Multiple combinations. e.g. IIA plus III plus IV in a molten or liquid form. e.g. IIIA plus IIIB plus IV in a molten or liquid form.

VI. Incorporation of bodies to be carried by cellular SCR into any of the above methods which produce open or closed cellular SRC's.

DISCLOSURE OF THE INVENTION

As-mined coal is air-dried to the desired moisture level (usually 0–10%). It is then dried and pulverized in an inert atmosphere to afford a powder 70% of which will pass through a 200 mesh screen. This material is then stored in an inert atmosphere until use.

A slurry of the pulverized coal in anthracene oil is then prepared by mixing 1–4 parts of the solvent to one part coal (by weight). Preferably the solvent is produced by the Solvent Refined Coal Method, as set forth below. Such solvents include anthracene oil, a coal tar distillate, which boils in the 300°–800° F. range. Other solvents such as tetralin, creosote oil, phenol, and creosols are also suitable. The slurry is charged to a high pressure vessel of sufficient size that the slurry occupies about half of the volume of the vessel. The vessel is sealed, flushed with hydrogen, and pressured to the desired initial pressure with hydrogen. The initial pressure is calculated so that the pressure is 1000–4000 p.s.i. at the desired reactor temperature. The vessel is heated (700°–900° F.) and held there for the desired time (5 to 60 minutes). The vessel is cooled to about 300° F. and depressured to slightly above atmospheric pressure. The gases are collected and measured by a suitable means. The liquid slurry remaining in the vessel is forced out of it through a diptube extending to the bottom of the vessel. The slurry is filtered while hot through a filter capable of operating under pressure. The filtrate is transferred to a distillation vessel and distilled at reduced pressure (5–40 mm.) to a maximum boiling point corresponding to that of the charge solvent. The residue from the distillation is solvent refined coal. The filter cake is subjected to pyrolysis or extracted with a suitable solvent to recover additional reaction solvent and solvent refined coal. The yield of solvent refined coal will be 40–70% based on moisture-ash-free (MAF) coal charged.

| | ANALYSES | | | |
|---|---|---|---|---|
| | RAW COAL | | SOLVENT REFINED COAL | |
| % C | 51.0 | 58.0 | 89.6 | 85.9 |
| H | 3.9 | 2.4 | 5.6 | 5.8 |
| 0 | 22.2 | 16.3 | 2.8 | 5.7 |
| N | 0.7 | 1.0 | 1.4 | 2.4 |
| S | 0.6 | 0.8 | 0.6 | 0.2 |
| Ash | 21.6 | 21.5 | Trace | Trace |
| $H_2O$ | 5.5 | 4.3 | Trace | Trace |

BTU values of solvent refined coal are generally in the 15–16000Btu/lb. range; that of the cellular material are in the range of 0.75 to 15200.

The melting point of SRC is not sharp and will vary with the conditions of manufacture. It will generally be a brittle solid at room temperature and melt from 212°–400° F. (100°–205° C.).

SRC is comletely soluble in pyridine and quinoline, partially soluble in benzene and insoluble in aliphatic hydrocarbons.

A typical SRC material was ground to a coarse powder, mixed and had the following properties:

C, 89.2%; H, 4.7%. Melting Range, 110°–205° C. Apparent Density, 0.600 g/cc. at 25° C. (loose powder) 0.764 g/cc. at 25° C. (firm powder)

The actual density was estimated at 1.2–1.4 g/cc at 25° C. (the individual particles sink readily in $H_2O$).

The invention is further illlustrated in nonlimiting fashion by the following examples.

EXAMPLE I

A sample of solvent refined coal (SRC) was placed into a 3-gram vial and tamped to a layer about 9.5 mm. deep. After heating for one minute in an oil bath at about 235° C., the sample shrank to a depth of 5 to 6 mm. The resulting mass is smooth and shiny and sinks in water.

EXAMPLE II

The procedure of Example I above was carried out with a 1.0 wt. % of mixture of maleic anhydride in SRC as a blowing agent. A tamped layer about 9 mm. deep of the mixture expanded to about 11 mm. The resultant product was broken into small aggregates and found to float on agitated water.

EXAMPLE III

A sample of SRC was reduced to a very fine powder in a small blender and further pulverized in a small vibrating ball mill. The powder was packed into a melting point capillary tube to a depth of about 4 mm. by vibration and impact. On heating at 220° C. for 5 minutes the depth of the material showed no change.

EXAMPLE IV

The procedure of Example III above was carried out with 0.5 wt. % blends of various substances which generate gas at elevated temperatures, especially when combined with SRC. These substances all produced expansions of over 100% in 4 to 10 mm. layers of SRC blends in capillary tubes at 220° C. after 5 minutes: maleic anhydride, maleic acid, oxalic acid, fumaric acid, and succinic acid.

EXAMPLE V

Proceeding as in Example III, tests were run simultaneously with a range of concentrations of maleic anhydride with these observed results:

| Wt. % Maleic Anhydride | % Expansion |
|---|---|
| 0.0 | Nil |
| 1.0 | 25% |
| 1.0 | 100% |

EXAMPLE VI

Tests essentially the same as Example III above were conducted at different temperatures with 0.5 wt. % blends of maleic anhydride. After five minutes of heating, these results were obtained.

| Temp., ° C | % Expansion |
|---|---|
| 190 | 50 to 100 |
| 200 | 50 to 100 |
| 210 | 100 to 150 |
| 220 | 100 to 150 |

EXAMPLE VII

A test similar to Example VI above was conducted with 0.5 wt. % blends of oxalic acid, fumaric acid, maleic acid, and maleic anhydride as well as SRC itself where the temperature was slowly increased from 180° to 220° C. It was observed that overall expansion was nil to $\approx$ 50%. Exceptionally large voids tended to form in some cases followed by collapse.

EXAMPLE VIII

A test essentially the same as Example II above is conducted with SRC at 240° C. Observed expansion is $\approx$ 50% due to the formation of some irregular voids.

EXAMPLE IX

A test essentially the same as Example I above is conducted with SRC at 240° C. Some gas is evolved as the volume shrinks in the absence of capillary effects.

EXAMPLE X

A sample of finely powdered SRC is heated throughout at a sintering temperature. Upon cooling the mass is found to be cellular and does not sink in water.

EXAMPLE XI

A sample of finely powdered SRC is blended with various known blowing agents in concentrations of 0.01 to 10 wt. % of sodium bicarbonate, sodium carbonate, dinitroso pentamethylene tetramine, azodicarbonamide, p,p'-oxybis (benzene sulfonyl hydrazide), p-toluene sulfonyl semicarbazide, barium azodicarboxylic acid, and diisopropyl azo dicarboxylate and heated to 150° to 350° C. for periods of 1 second to 20 minutes. The result is a cellular SRC with apparent density of 95 to 1% of the actual density of the prefoamed SRC, i.e., a void volume of 5 to 99%.

EXAMPLE XII

A "solvent" modified SRC is made with a lower temperature range in which it behaves as a fluid plastic phase by admixture with solvents such as pyridine or quinoline. Admixture with lower (than SRC) melting solids such as naphthalene also gives a lower melting range SRC.

EXAMPLE XIII

A cellular SRC is produced by mechanically frothing raw SRC or SRC of EXAMPLE XII with a gas such as $CO_2$, CO, $H_2$, $N_2$, $O_2$, or air at an elevated temperature and cooling.

EXAMPLE XIV

A SRC of Example XII is blended with various known blowing agents in concentrations from 0.01 to 20% of diazoaminobenzene, azobis (isobutyronitrile), N,N'-dinitroso-N,N'-dimethylenephthalamide and p-toluene sulfonyl hydrazide and heated to 80° to 150° C. for periods of 1 to 600 seconds. The result is a cellular SRC with apparent density of 95 to 1% of the actual density of the prefoamed SRC, i.e., a void volume of 5 to 99%.

EXAMPLE XV

A SRC of Example XII of a raw SRC is blended with an insoluble cellular material (sawdust or glass microballons) while the SRC is in a fluid plastic state. Upon reverting to the solid state, syntactic cellular SRC is formed. Glass microballons with 0.1mm diameter give a floating syntactic cellular SRC.

EXAMPLE XVI

A SRC as in Examples I, II, XII, XIII, and XV is blended with a leachable insoluble material (sodium sulfate) while the SRC is in the fluid plastic state. Upon reverting to the solid state, the mass is leached with a suitable solvent such as water which removes the leachable material leaving a reticulated form of SRC, which when dried is filled with air pockets.

EXAMPLE XVII

A cellular SRC is produced according to Examples XI or XIV using as blowing agents materials from Example IV.

EXAMPLE XVIII

A cellular SRC is produced according to Examples XI or XIV without added blowing agents, i.e., by heating powdered SRC or by heating SRC incorporating solvents.

EXAMPLE XIX

A cellular SRC is produced according to Examples X to XVIII where the SRC acts as a carrier for a material such as raw coal, diamond particles, alumina, and other materials which are compatible with cellular SRC and methods to produce it.

EXAMPLE XX

A cellular SRC is produced according to Example X using SRC modified as in Example XII.

A primary advantage of cellular SRC is its buoyancy in water. This allows SRC to be shipped without containers on waterways and even be cast into barges to carry other materials. Cellular SRC can be molded into ships which can be sailed or otherwise powered over oceans. In pipelines, cellular SRC eliminates settling out when flow must be interrupted. Pipeline abrasion also is reduced. Blends of coal and SRC can be made into cellular form to facilitate raw coal transportation.

The cellular forms of SRC are useful in building materials as extenders, acoustic and thermal insulation, and as a structural material and component of road-making compositions because of their particular densities, structures, compositions and low cost availability.

Road compositions for cold climates may be particularly improved by the addition of cellular SRC especially in combination with sulfur road compositions.

Cellular SRC also is useful as a filtration and demisting medium and as a support material for chromatography.

The cellular form of SRC allows combustion of coal to take place more rapidly and completely and allows it to be intimately contacted with other fuels such as in solid fuel compositions by coating or filling an open cellular SRC with another material.

Cellular SRC is more easily made into a powder or to particular shapes not readily available through grinding or crushing of ordinary SRC.

What is claimed is:

1. A cellular form of solvent refined coal having a plurality of cells, an apparent density less than 1g/cc and a void volume of 5 to 99%, said form consisting of a continuous, syntactic foamed carbonaceous mass produced by heating and foaming said solvent refined coal.

2. The coal of claim 1, wherein said cells are interconnected.

3. The coal of claim 1, whrein said cells are closed.

4. A method for making cellular solvent refined coal of apparent density less than 1 and a void volume of 5 to 99% comprising providing a solvent refined coal having a melting point in the range of 100° to 250° C.; heating said coal above said melting point to form a plastic mass and further reacting said mass under cell-forming conditions to form a plurality of cells therein.

5. The method of claim 4, wherein said cells are formed by mechanically dispersing a quantity of gas in said plastic mass.

6. The method of claim 4, comprising mixing a leachable insoluble material with said plastic mass and leaching the resulting mixture.

7. The method of claim 4, wherein said cells are formed by mixing cell forming agents with said coal and heating the resulting mixture above its melting point.

8. The method of claim 4, wherein said cells are formed by heating said coal in pyridine or quinoline.

9. The method of claim 4, wherein said cells are formed by heating said coal in a solvent and mechanically frothing the resulting fluid plastic mass with a gas at an elevated temperature above the melting point of said mass and cooling.

10. The method of claim 4, comprising blending said coal with 0.01 to 10 weight percent of a blowing agent and heating the resulting blend to 100° to 350° C. for a period of 1 second to 60 minutes.

* * * * *